US006155286A

United States Patent [19]

Geary

[11] Patent Number: 6,155,286

[45] Date of Patent: Dec. 5, 2000

[54] WASHING MACHINE OUTLET BOX

[75] Inventor: Susan M. Geary, Parma, Ohio

[73] Assignee: Oatey Co., Cleveland, Ohio

[21] Appl. No.: 09/258,963

[22] Filed: Mar. 1, 1999

[51] Int. Cl.[7] ..... F16L 5/00

[52] U.S. Cl. ..... 137/360; 137/269; 137/271; 312/229

[58] Field of Search ..... 137/269, 271, 137/360; 312/229

[56] References Cited

U.S. PATENT DOCUMENTS

| | | | |
|---|---|---|---|
| 3,259,919 | 7/1966 | Cipriano | 137/271 |
| 3,831,624 | 8/1974 | Doumany | 137/360 |
| 4,410,004 | 10/1983 | Kifer et al. | 137/360 |
| 4,716,925 | 1/1988 | Prather | 137/360 |
| 4,782,852 | 11/1988 | Legris | 137/271 |
| 4,865,072 | 9/1989 | Logsdon | 137/360 |
| 4,934,410 | 6/1990 | Humber | 137/360 |

*Primary Examiner*—A. Michael Chambers
*Attorney, Agent, or Firm*—Renner, Otto, Boisselle & Sklar, LLP

[57] ABSTRACT

A washing machine outlet box includes a housing having a bottom wall containing a first valve mount for a first shutoff valve of a first water supply line and a valve mount insert that forms a second valve mount for a second shutoff valve of a second water supply line. The valve mount insert is selectively positionable in any one of several openings in the bottom wall to accommodate the second water supply line. A drain pipe is connected to one of the openings in which the valve mount insert is not selectively positioned. A test cap forms a seal for the drain pipe opening. In this manner, the washing machine outlet box can accommodate different plumbing arrangements.

15 Claims, 3 Drawing Sheets

WASHING MACHINE OUTLET BOX

FIELD OF THE INVENTION

The present invention relates to a washing machine outlet box that can accommodate different plumbing arrangements.

BACKGROUND OF THE INVENTION

Washing machine outlet boxes are frequently used in new construction or remodeling to provide the plumbing connections necessary for a washing machine. A washing machine outlet box typically includes a housing having a bottom wall with at least three openings. One of the openings is used for connection of a drain pipe, whereas the other two openings are for the hot and cold water supply lines. Valve mounts, extending upwardly from the bottom wall, provide elevated platforms for the shutoff valves of the water supply lines.

When a washing machine outlet box is first installed, the drain opening must be sealed in an air tight manner for pressure testing of the sanitary drainage system for leaks. Once testing is completed, the drain line is opened to allow for insertion of the washing machine drain hose. To this end, the drain pipe opening in a washing machine outlet box is typically temporarily sealed with a test cap. The test cap usually has a central knock-out portion that is joined to the other portions of the cap by a frangible seam. After pressure testing is completed, the central portion is tapped with, for instance, a screwdriver and hammer, to disconnect it from the surrounding portions of the test cap thereby opening the drain line.

The drain pipe and water supply lines may be installed in several different arrangements depending on the particular plumbing layout and type of washing machine outlet box the plumber wishes to use. For example, different designs of washing machine outlet boxes can accommodate either right-hand, left-hand or center drains.

It is generally known to provide a single washing machine outlet box that can accommodate more than one plumbing arrangement because of inventory considerations. However, there is a continuing need to provide a single washing machine outlet box that can more easily be adapted to accommodate at least two different drain arrangements, for example, either a right-hand or a left-hand drain.

SUMMARY OF THE INVENTION

The present invention provides a washing machine outlet box that readily accommodates two different drain arrangements. The box's housing includes a bottom wall having first, second and third openings formed therein. A permanent first valve mount is provided for the shutoff valve of a first water supply line that extends through the first opening. A separate valve mount insert is selectively mounted in either of the other two openings to form a second valve mount for the shutoff valve of a second water supply line.

The other opening in which the separate valve mount insert is not mounted is used as the drain opening. A test cap is selectively positionable in the drain opening to seal the drain opening during pressure testing of the sanitary drainage system.

In this manner, the washing machine outlet box accommodates both a plumbing arrangement wherein the drain pipe will be connected to the second opening and the second water supply line extends through the third opening and a plumbing arrangement wherein the drain pipe will be connected to the third opening and the second water supply line will extend through the second opening.

If the washing machine outlet box is intended to only accommodate a right-hand and a left-hand drain pipe arrangement, a water supply line and its shutoff valve will always be installed in the central opening. Accordingly, the first valve mount could be fixedly positioned to the housing as by integrally forming the first valve mount with the bottom wall of the housing and more particularly by forming the first valve mount in one piece with the bottom wall of the housing.

Cooperating locking members are preferably provided to lock the valve mount insert into position relative to the housing. Preferably, these locking members include tabs on the valve mount insert that mate with locking stations on the box's housing. The preferred locking stations each include a recess or pocket shaped for receipt of one of the tabs and a ramp leading into the recess. When the valve mount insert is rotated in a predetermined twist direction, each tab rides up the ramp of the respective locking station and is then captured in its recess to lock the valve mount insert to the box's housing.

In the preferred washing machine outlet box, both the second and third openings are surrounded by an annular seat. The valve mount insert includes a circumferential flange that is sized and shaped to rest against either of these annular seats. An O-ring captured within a groove in the flange's bottom surface forms a water tight seal between the annular seat and the circumferential flange.

The test cap includes a circumferential flange that is sized and shaped to be solvent welded to either of the annular seats to provide an air tight seal for pressure testing of the sanitary drainage system. A central knock-out portion of the test cap is preferably attached to its surrounding portions by a frangible seam. In the preferred test cap, the frangible seam is interrupted at two relatively small areas positioned 1800 apart thereby dividing the seam into two sections and creating a hinge line between the two halves of the central portion. Upon breaking of the frangible seam sections, the halves of the central portion will be attached to the cap's other portions only at the areas at the ends of the hinge line.

The test cap may further include a pull handle extending upwardly from the hinge line. The pull handle may be used to conveniently break the remaining attachment between the central portion and the other portions of the test cap. Specifically, by grasping the handle with a pliers and pulling upward, the central or knock-out portion will be released. This eliminates the possibility of the knockout portion falling into the drain pipe and having to be fished out by hand.

To the accomplishment of the foregoing and related ends, the invention then, comprises the features hereinafter fully described and particularly pointed out in the claims. The following description and annexed drawings set forth in detail one illustrative embodiment of the invention. This is indicative, however, of but one of the various ways in which the principles of the invention may be employed.

DRAWINGS

DETAILED DESCRIPTION

Figure 1A:
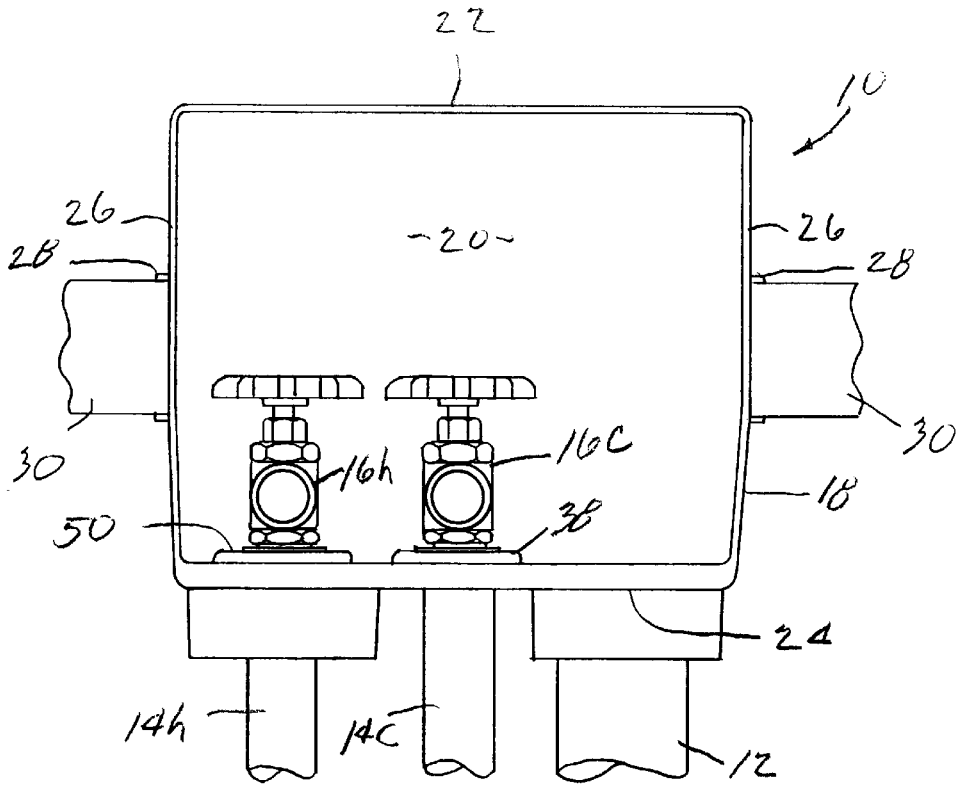
FIG. 1A is a front view of a washing machine outlet box according to the present invention with a drain pipe, water supply lines and shutoff valves installed in a right-hand drain arrangement.
Figure 1B:
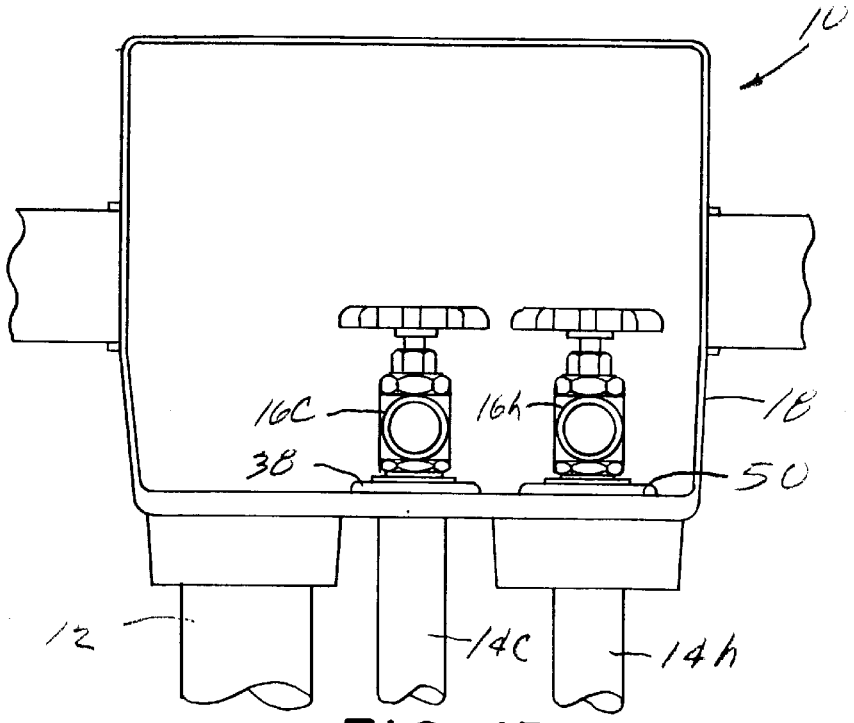
FIG. 1B is a front view similar to FIG. 1A except that the plumbing is installed in a left-hand drain arrangement.

A washing machine outlet box 10 according to the present invention is shown in FIGS. 1A and 1B. The washing machine outlet box 10 is constructed to accommodate both a right-hand drain arrangement and a left-hand drain arrangement. Specifically, as shown in FIG. 1A, the box 10 allows a right-hand connection of a drain pipe 12 relative to water supply lines 14*c* and 14*h* and their associated shutoff valves 16*c* and 16*h*. As shown in FIG. 1B, the box 10 also allows a left-hand connection of the drain pipe 12 relative to the water supply lines 14 and their associated shutoff valves 16. In this manner, a plumber does not have to keep an inventory of different washing machine outlet boxes to accommodate both right-hand and left-hand drain arrangements.

The washing machine outlet box 10 comprises a generally rectangular housing 18. The housing 18 includes a rear wall 20, a top wall 22, a bottom wall 24, and side walls 26.

Attached to the outer surface of each side wall 26 of the housing 18 are loops 28 for receipt of mounting brackets 30. In this manner, the washing machine outlet box 10 may be mounted by means of the mounting brackets 30 to studs or other structural members of a building before the wall board or other sheet material is installed to finish the wall. Once the wall material is installed, the box 10 provides a finished look for the plumbing of a washing machine or the like.

Figure 2A:
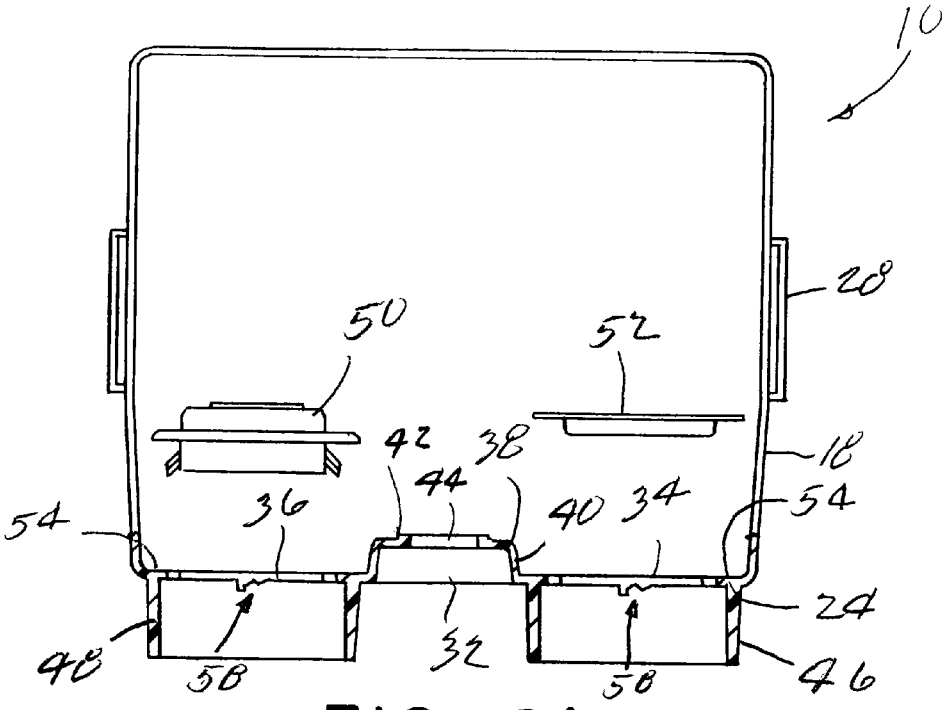
FIG. 2A is a front exploded view of the components of the washing machine outlet box (namely a housing, a valve mount insert, and a test cap) positioned to accommodate a right-hand drain arrangement in the bottom wall of the box, shown in section.
Figure 2B:
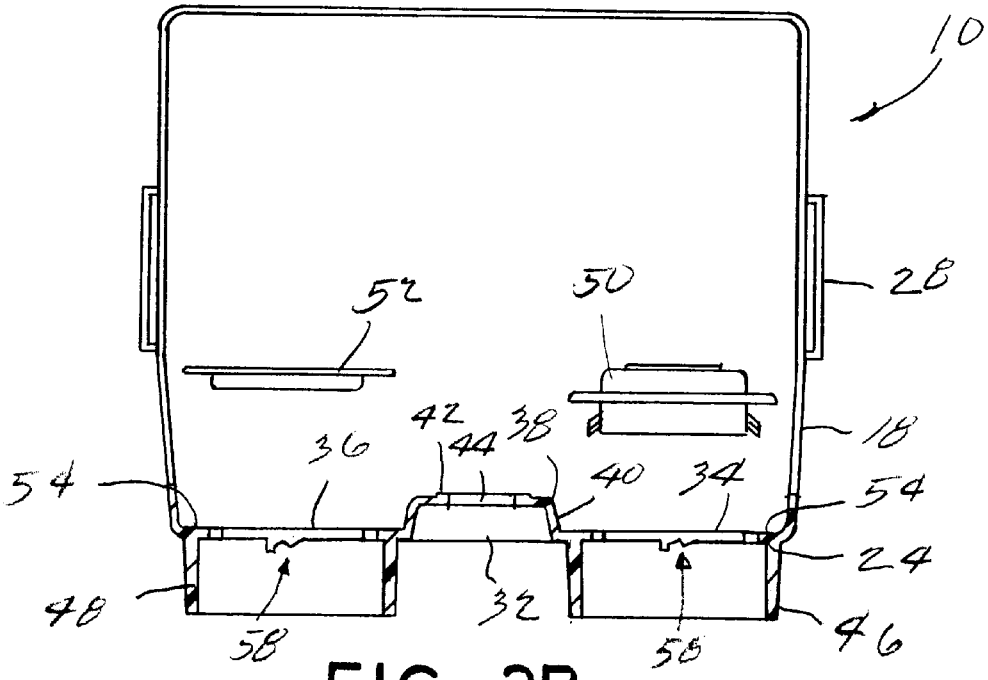
FIG. 2B is a front exploded view similar to FIG. 2A except that the components are positioned to accommodate a left-hand drain arrangement.

Referring now additionally to FIGS. 2A and 2B, the box's bottom wall 24 includes a central opening 32, a right-hand opening 34, and a left-hand opening 36.

The illustrated washing machine outlet box 10 is intended to accommodate either a right-hand drain arrangement or a left-hand drain arrangement. Accordingly, a first valve mount 38 may be integrally formed, and more particularly formed in one piece, with the bottom wall 24 in line with the central opening 32. This conveniently allows for one of the shutoff valves 16 (see FIGS. 1A and 1B) to be mounted on the valve mount 38 at the factory so the plumber doesn't have to do it in the field. In the illustrated embodiment, the valve mount 38 accommodates the cold water supply line 14*c* and its shutoff valve 16*c*. It could, of course, instead accommodate the hot water supply line 14*h* and its shutoff valve 16*h*.

The first valve mount 38 provides an elevated platform for the shutoff valve 16*c*. To this end, the illustrated valve mount 38 includes a cylindrical wall 40 extending upwardly around the central opening 32 and a planar top wall 42. The top wall 42 includes a central opening 44 to accommodate the stem of the shutoff valve 16*c* and the connection of the water supply line 14*c* thereto.

The washing machine outlet box 10 includes a drain tail piece 46 extending downward around the right-hand opening 34 and another drain tail piece 48 extending downward around the left-hand opening 36. The tail pieces 46 and 48 are each preferably integrally formed, and more preferably formed in one piece, with the bottom wall 24. In a right-hand drain pipe arrangement, the drain pipe 12 is solvent welded to the tail piece 46 (FIG. 1A). In a left-hand drain pipe arrangement, the drain pipe 12 is solvent welded to the tail piece 48 (FIG. 1B).

The washing machine outlet box 10 additionally includes a separate valve mount insert 50 and a test cap 52. For a right-hand drain arrangement, the valve mount insert 50 is inserted into the left-hand opening 36 and the test cap 52 is used to temporarily seal the right-hand opening 34 during pressure testing of the sanitary drainage system (FIG. 2A). For a left-hand drain arrangement, the valve mount insert 50 is secured in the right-hand opening 34 and the test cap 52 is used to temporarily seal the left-hand opening 36 (FIG. 2B).

Figure 3:
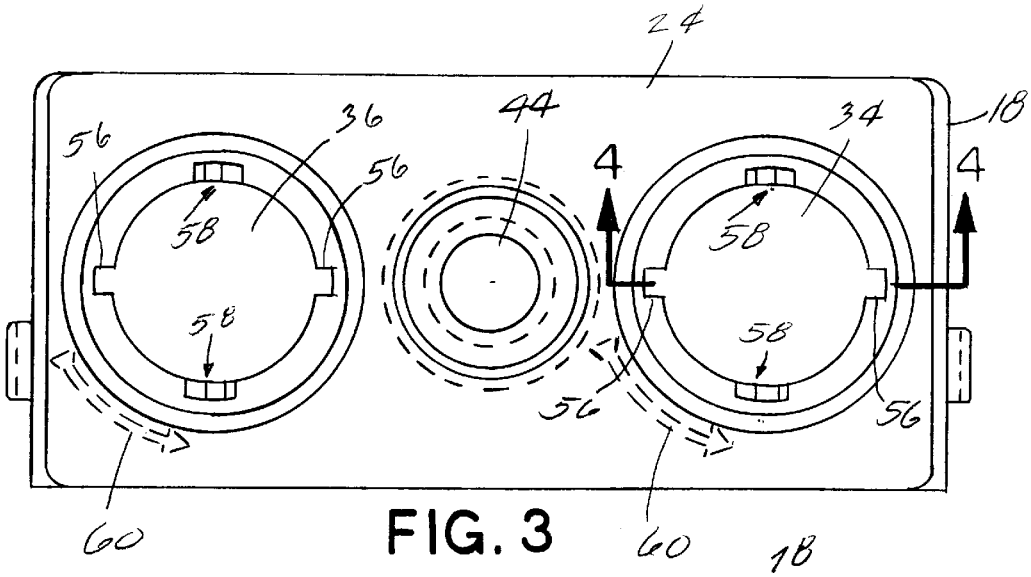
FIG. 3 is an enlarged bottom view of the bottom wall of the housing.

Referring to FIGS. 2 and 3, an annular seat 54 surrounds both the right and left-hand openings 34 and 36. The radially inner edge of each seat 54 is interrupted by a pair of rectangular slots 56 positioned 1800 apart from each other. In the illustrated orientation, the slots 56 are located at the three o'clock and nine o'clock positions relative to the housing's front edge.

A pair of locking stations 58 are positioned below each seat 54 and adjacent the respective openings 34 and 36. The locking stations 58 are positioned 180° apart from each other and positioned 90° apart from the rectangular slots 56. In the illustrated orientation, the locking stations 58 are located at the twelve o'clock and six o'clock positions relative to the housing's front edge. As is explained in more detail below, the notches 56 and the locking stations 58 are used to provide a twist lock connection when the valve mount insert 50 is turned or twisted in the direction 60 (see FIG. 3).

Figure 4:
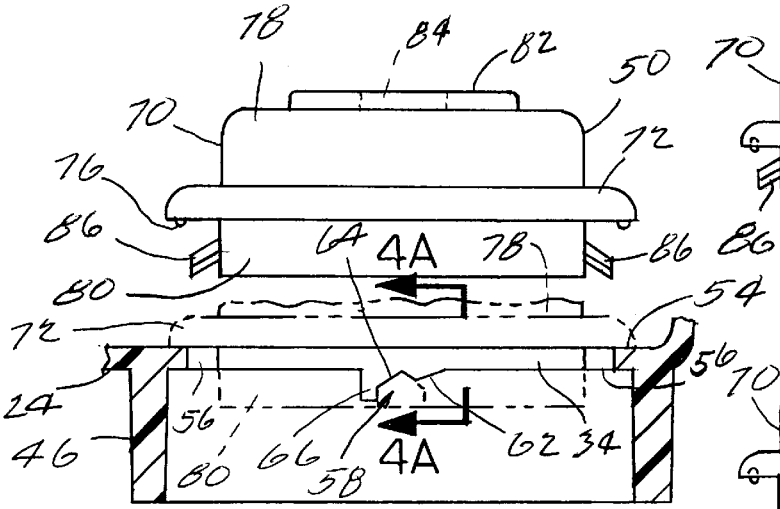
FIG. 4 is a further enlarged fragmentary section through a portion of the housing of FIG. 3, namely a locking station and adjacent portions of the bottom wall, taken on the plane of the line 4—4 of FIG. 3.
Figure 4A:
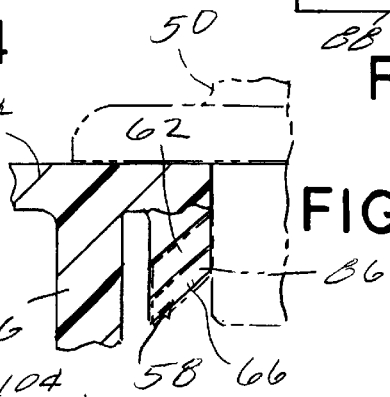
FIG. 4A is a further enlarged fragmentary transverse section through the bottom wall of FIG. 4 adjacent one of the locking stations, taken on the plane of the line 4A—4A thereof.

Referring to FIGS. 4 and 4A, one of the locking stations 58 is shown in enlarged detail. The locking station 58 includes a ramp 62, a V-shape notch or recess 64, and a stop shoulder 66 sequentially positioned in this order relative to the twisting direction 60. The ramp 62 provides an approximately 60° incline into the recess 64. The recess 64 captures a locking tab on the valve mount insert 50 as described hereafter. The stop shoulder 66 extends outwardly from the trailing edge of the recess 64 to prevent the valve mount insert 50 from moving past the locking station 58. The sides of the locking station 58 forming the ramp 62, the recess 64 and the stop ledge 66 preferably slope downward at an angle for example of approximately 40° relative to the seat 54 (see FIG. 4A).

Figure 5:
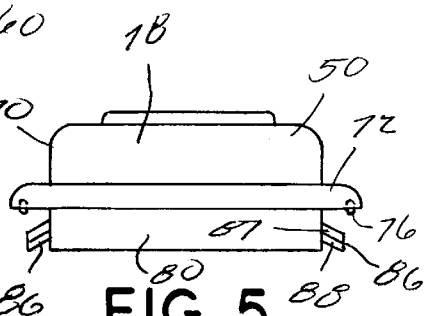
FIG. 5 is an enlarged front view of the valve mount insert.
Figure 6:
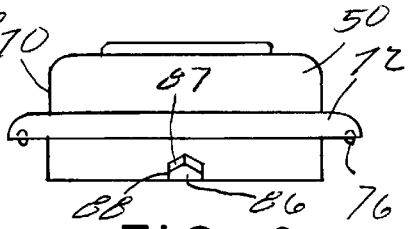
FIG. 6 is an enlarged side view of the valve mount insert.
Figure 7:
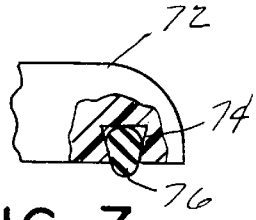
FIG. 7 is a further enlarged view, partially in section, of a portion of the valve mount insert, namely an edge portion of its circumferential flange.

Referring to FIGS. 5–7, the valve mount insert 50 is shown isolated from the other components of the washing machine outlet box 10. The valve mount insert 50 includes a cylindrical wall 70 and a circumferential flange 72 extending outwardly therefrom. The flange 72 is sized and shaped to rest upon either of the annular seats 54 surrounding the openings 34 and 36 in the bottom wall 24.

As shown in FIG. 7, the flange 72 may include a groove 74 in its lower surface for receipt of an O-ring 76. The groove 74 is preferably reverse wedge shaped (in cross-section) so that the O-ring 76 will be captured therein without having to glue it in place. The groove 74 is located so that it will be radially positioned outward from the slots 56 (FIG. 4) and the O-ring 76 protrudes sufficiently beyond the flange's bottom surface to form a fluid tight seal around either of the openings 34 and 36 in the bottom wall 24.

The circumferential flange 72 may be viewed as separating the valve mount insert 50 into an upper portion 78 and a lower portion 80. When the valve mount insert 50 is assembled in one of the openings 34 and 36 in the bottom wall 24, the upper portion 78 extends above the bottom wall 24 and the lower portion 80 extends below the bottom wall as shown in phantom lines in FIG. 4. The upper portion 78 of the insert 50 is substantially identical in shape and size to the first valve mount 38 and forms a second valve mount for the other water supply line 14*h* and its shutoff valve 16*h*. Specifically, the upper portion 78 forms an elevated platform including a planar top wall 82 with an opening 84.

The lower portion 80 includes a pair of locking tabs 86 protruding outwardly from the cylindrical wall 70 positioned 180° apart. The tabs 86 are sized to pass through the slots 56 beneath the bottom wall 24 and shaped to be captured within the recesses 64 when the valve mount insert 50 is turned in the twist direction 60 (FIG. 3). To this end, the locking tabs 86 each have a V-shaped top wall 87 that corresponds in shape to V-shape recesses 64. Also, the locking tabs 86 slope downward and outward from the cylindrical wall 70 at approximately the same angle (e.g., 40°) as the sides of the locking stations 58 for sliding engagement therewith as schematically shown in FIG. 4A.

As was indicated above, to assemble the washing machine outlet box 10 for a right-hand drain arrangement, the valve mount insert 50 is inserted into the left-hand opening 36 (FIGS. 1A and 2A). Alternatively, to assemble the washing machine outlet box 10 for a left-hand drain arrangement, the valve mount insert 50 is inserted into the right-hand opening 34 (FIGS. 1B and 2B). In either event, the valve mount insert 50 is initially oriented so that its locking tabs 86 are aligned with the slots 56 (FIGS. 2 and 4). The valve mount insert 50 is then moved downward to insert its locking tabs 86 through slots 56 and then turned in the twist direction 60 (FIG. 3) until its locking tabs 86 are trapped within the recesses 64. Particularly, the tab's leading side, which slopes in the same direction as the ramp 62, causes the locking tab 86 to "ride up" the ramp 62. Once the locking tab passes over the "top" of the ramp, the locking tab is snapped into the recess 64. The station's stop ledge 66 blocks further movement of the locking tab 86 in the twist direction 60 thereby preventing overturning of the valve mount insert 50. The corresponding V-shape geometry of the top wall 87 of the tab 86 and the recess 64 resists the valve mount insert 50 from being released from the locking stations 58 and/or turned in the opposite direction.

Thus, the valve mount insert 50 may be locked into position relative to the selected opening 34/36. In this position, its circumferential flange 72 rests firmly against the annular seat 54 surrounding the opening 34/36. The O-ring 76, which protrudes below the flange's bottom surface and which is positioned radially outward from the slots 56, provides a water tight seal between the valve mount insert 50 and the seat 54 (FIGS. 4, 5 and 7).

Since the valve mount insert 50 is always rotated 90° in the same direction to lock the valve mount insert in either of the selected opening 34 or 36, if desired the associated shutoff valve 16 can be factory mounted on the valve mount insert in the required orientation (i.e., with the valve spigot oriented 90° to the mounting tabs) to eliminate the need to mount the valve on the insert in the field.

As was indicated above, the illustrated washing machine outlet box 10 is intended to accommodate either a right-hand drain pipe arrangement or a left-hand drain pipe arrangement. As such, the first valve mount 38 is fixedly positioned above the central opening 32 (FIGS. 1–3). However, a washing machine outlet box that accommodates other plumbing arrangements is possible with, and contemplated by, the present invention. For example, the first valve mount 38 could instead be fixedly positioned above a right-hand opening or a left-hand opening. Moreover, the first valve mount 38 could be formed by a valve mount insert that could be essentially identical to the valve mount insert 50. In the latter case, the portions of the bottom wall 24 surrounding the central opening 32 would preferably be the same as the portions surrounding the right-hand and left-hand openings 34 and 36. Additionally, a third tail piece could be provided around the central opening 32.

Figure 8:
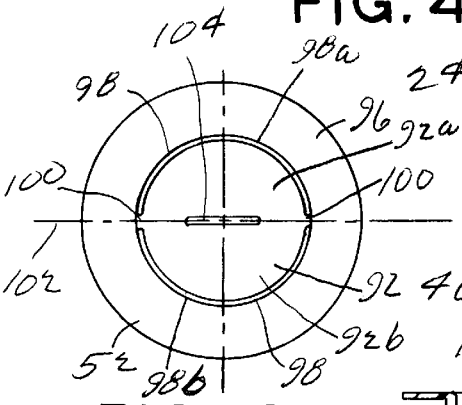
FIG. 8 is a top view of the test cap.
Figure 9:
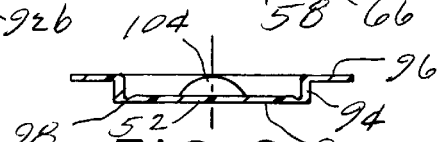
FIG. 9 is a transverse section through the test cap of FIG. 8.

Referring now to FIGS. 8 and 9, the test cap 52 is illustrated isolated from the other components of the washing machine outlet box 10. The test cap 52 includes a central circular portion 92, a cylindrical rim 94, and a circumferential flange 96. The cylindrical rim 94 extends upwardly from the circumferential edge of the central portion 92. The circumferential flange 96 extends outwardly from the top edge of the rim 94. When the test cap 52 is assembled into either the right-hand opening 34 or the left-hand opening 36, its central portion 92 and its rim 94 are received within the opening 34/36 and the tail piece 46/48. The circumferential flange 96 is solvent welded to the seat 54 surrounding the drain opening 34/36 to make the drain opening air tight during pressure testing of the sanitary drainage system.

After completion of the pressure testing, the drain line is opened for receipt of the drain hose of the washing machine. This is accomplished by removal of the central portion 92 of the test cap 52. To this end, the test cap 52 includes a frangible seam 98 joining its central portion 92 to its other portions, and particularly the lower edge of the rim 94, thus making the central portion 92 a knock-out portion.

The seam 98 is preferably interrupted by two relatively small areas 100 of the central portion 92 that are positioned 1800 apart. The areas 100 divide the seam 98 into two arcuate sections 98*a* and 98*b* each being slightly less than 180°.

A line 102 drawn between the two areas 100 of the seam 98 divides the central portion 92 into two semi-circular halves 92*a* and 92*b*. When the two halves 92*a* and 92*b* are tapped, for instance, by a screwdriver and hammer, the seam sections 98*a* and 98*b* will split, leaving the central portion 92 attached to the rim 94 by the relatively small areas 100. Also, the line 102 forms a hinge line between the central portion's semicircular halves 92*a* and 92*b*.

A pull handle 104 is preferably provided on the central portion 92 for grasping by a pliers to pull the central portion 92 away from the rim 94 to thereby break the remaining attachments therebetween. In the illustrated embodiment, this pull handle 104 comprises a flat member extending upwardly from, and positioned centrally relative to, the hinge line 102. In this manner, by grasping the handle 104 and pulling upward, the central portion 92 may be removed from the other portions 94 and 96 of the test cap 52 thereby opening the drain line.

Although the invention has been shown and described with respect to certain embodiments, it is obvious that equivalent alternations and modifications will occur to others skilled in the art upon reading and understanding the specification. The present invention includes all such equivalent alterations and modifications, and is limited only by the scope of the following claims.

What is claimed is:

1. A washing machine outlet box comprising a housing including a bottom wall containing a plurality of openings, and a valve mount insert that forms a valve mount for a first shutoff valve of a first water supply line, the valve mount insert being selectively positionable in any one of the plurality of openings in the bottom wall, and locking components for locking the valve mount insert into the selected position.

2. A washing machine outlet box as set forth in claim 1 further comprising an integrally formed valve mount on the bottom wall for a second shutoff valve of a second water supply line.

3. A washing machine outlet box as set forth in claim 2 wherein an other opening is located between a first and second of the openings whereby the other opening is a central opening, the first opening is a right-hand opening and the second opening is a left-hand opening, and the integrally formed valve mount is in line with the central opening, whereby the washing machine outlet box accommodates both a plumbing arrangement wherein the valve mount insert is positioned in the left-hand opening and a drain pipe is connected to the right-hand opening and a plumbing arrangement wherein the valve mount insert is positioned in the right-hand opening and the drain pipe is connected to the left-hand opening.

4. A washing machine outlet box as set forth in claim 3 wherein the integrally formed valve mount and the valve mount insert provide raised platforms for the shutoff valves.

5. A washing machine outlet box as set forth in claim 1 wherein the locking components comprise locking tabs on the valve mount insert and locking stations on the housing to receive the locking tabs.

6. A washing machine outlet box as set forth in claim 5 wherein the locking stations each comprise a recess shaped to capture one of the locking tabs and a ramp leading into the recess when the valve mount insert is turned in a twist direction.

7. A washing machine outlet box as set forth in claim 6 wherein the recess is V-shaped.

8. A washing machine outlet box as set forth in claim 1 wherein annular seats surround the openings, and wherein the valve mount insert includes a circumferential flange that is sized and shaped to rest against any one of the annular seats.

9. A washing machine outlet box as set forth in claim 8 further comprising an O-ring captured within a reverse wedge shaped groove in a bottom surface of the circumferential flange of the valve mount insert which forms a fluid seal with the annular seat of the selected opening into which the valve mount insert is inserted.

10. A washing machine outlet box as set forth in claim 1 wherein a drain pipe is connected to one of the openings in which the valve mount insert is not positioned, further comprising a test cap insertable into the drain pipe opening to form a fluid tight seal at the drain pipe opening during pressure testing.

11. A washing machine outlet box as set forth in claim 1 further comprising tail pieces surrounding the openings for selectively connecting a drain pipe to one of the openings in which the valve mount insert is not positioned.

12. A washing machine outlet box comprising a housing including a bottom wall having first, second and third openings formed therein, a valve mount for a first shutoff valve of a first water line integral with the bottom wall in line with the first opening, a valve mount insert that forms a second valve mount for a second shutoff valve of a second water supply line, the valve mount insert being selectively positionable in either of the second or third openings to accommodate the second water supply line, and separate tail pieces surrounding each of the second and third openings for connecting a drain pipe to the second or third opening in which the valve mount insert is not selectively positioned.

13. A washing machine outlet box as set forth in claim 12 wherein the first opening is located between the second and third openings whereby the first opening is a central opening, the second opening is a right-hand opening and the third opening is a left-hand opening, and whereby the washing machine outlet box accommodates both a plumbing arrangement wherein the second water supply line extends through the left-hand opening and the drain pipe is connected to the tail piece surrounding the right-hand opening and a plumbing arrangement wherein the second water supply line extends through the right-hand opening and the drain pipe is connected to the tail piece surrounding the left-hand opening.

14. A washing machine outlet box comprising a housing including a bottom wall containing a plurality of openings, a valve mount insert that forms a valve mount for a first shutoff valve of a first water supply line, the valve mount insert being selectively positionable in any one of the plurality of openings in the bottom wall, a drain pipe connected to one of the openings in which the valve mount insert is not positioned, and a test cap insertable into the drain pipe opening to form a fluid tight seal at the drain pipe opening during pressure testing, said test cap comprising a central portion attached to other portions of the test cap by a frangible seam whereby the central portion may be removed once pressure testing is completed, the frangible seam being interrupted by two relatively small areas positioned 180° apart thereby dividing the seam into two sections and creating a hinge line between two halves of the central portion whereby, upon breaking of the frangible seam sections, the halves of the central portion will be attached to each other along the hinge line and will only be attached to the other portions of the test cap insert by the relatively small areas.

15. A washing machine outbox as set forth in claim 14 wherein the test cap includes a pull handle protruding from the central portion in line with the hinge line.

* * * * *